US010406542B1

(12) United States Patent
D'Ascanio et al.

(10) Patent No.: US 10,406,542 B1
(45) Date of Patent: Sep. 10, 2019

(54) FOAMED BITUMEN DISPENSING DEVICE

(71) Applicant: Caterpillar Paving Products Inc., Brooklyn Park, MN (US)

(72) Inventors: Valerio E. D'Ascanio, Granarolo dell'Emillia (IT); Dario Sansone, Castello d'Argille (IT)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 15/995,820

(22) Filed: Jun. 1, 2018

(51) Int. Cl.

| | |
|---|---|
| ***B05B 7/00*** | (2006.01) |
| ***B05B 9/04*** | (2006.01) |
| ***E01C 23/06*** | (2006.01) |
| ***B05B 9/047*** | (2006.01) |

(52) U.S. Cl.
CPC ..... *B05B 7/0018* (2013.01); *B05B 9/047* (2013.01); *E01C 23/065* (2013.01)

(58) Field of Classification Search
CPC ..... E01C 19/02; E01C 19/08; E01C 19/10; E01C 19/1036; E01C 19/105; E01C 19/1054; E01C 21/00
See application file for complete search history.

(56) References Cited

U.S. PATENT DOCUMENTS 4,990,025 A * 2/1991 Young ..... E01C 21/00 404/92
6,565,281 B2 5/2003 Bruns et al.
6,887,013 B2 * 5/2005 Ley ..... B05B 1/3046 404/90
7,641,418 B2 * 1/2010 Hall ..... E01C 23/0885 404/72
9,506,205 B1 * 11/2016 Lee ..... E01C 21/00
9,856,611 B2 1/2018 Heusinger et al.
2008/0193214 A1 * 8/2008 Hall ..... E01C 23/065 404/75
2010/0156970 A1 * 6/2010 Ikushima ..... B05B 12/06 347/8
2010/0177138 A1 * 7/2010 Ikushima ..... B05C 5/0225 347/19
2013/0087172 A1 * 4/2013 Roetsch ..... E01C 21/00 134/8
2015/0098760 A1 * 4/2015 Menzenbach ..... B05B 1/3046 404/75
2015/0376847 A1 * 12/2015 Schlenker ..... E01C 23/065 404/91
2016/0024728 A1 * 1/2016 Menzenbach ..... E01C 23/127 299/1.05

FOREIGN PATENT DOCUMENTS

GB 877033 A 9/1961

* cited by examiner

*Primary Examiner* — Abigail A Risic
(74) *Attorney, Agent, or Firm* — Bookoff McAndrews

(57) ABSTRACT

A foamed bitumen dispensing device may include a body having a chamber and a bore fluidly connected to the chamber. The chamber may include an inlet for receiving bitumen. The foamed bitumen dispensing device may further include a valve fluidly connected to the bore. The valve may have a movable valve member including an opening for dispensing bitumen. The foamed bitumen dispensing device may also include a plunger configured to extend through the opening in the valve member.

20 Claims, 6 Drawing Sheets

FOAMED BITUMEN DISPENSING DEVICE

TECHNICAL FIELD

The present disclosure relates generally to foamed bitumen dispensing devices and methods of operating the same.

BACKGROUND

Milling machines, including rotary mixers, are used in a variety of applications to prepare a ground surface for road production. Rotary mixers, in particular, may be used as a soil stabilizer to cut, mix, and pulverize native in-place soils with additives or aggregates in order to strengthen the soil for use as a base in construction. A rotary mixer may also be used as a road reclaimer to pulverize a work surface, such as asphalt, mixing the pulverized surface with an underlying base to form a new, stabilized surface on which roadways can be constructed. During operation, the rotary mixer may add asphalt emulsions, such as foamed bitumen and/or other binding agents to develop a new surface during pulverization. A foamed bitumen dispensing device may deposit or spray foamed bitumen into the mixing chamber during pulverization through a nozzle. Through successive milling operations, bitumen may harden and build up on and around the nozzles thereby contaminating or clogging the dispensing device.

Cleaning the foamed bitumen dispensing devices may be difficult and time intensive due to the position of the devices on the underside of the rotary mixer, the configuration of the devices, and the location of the nozzle opening inside the mixing chamber. Generally, the foamed bitumen dispensing devices are cleaned by dismantling part of the milling assembly of the rotary mixer during scheduled service of the entire rotary mixer. Thus, foamed bitumen dispensing devices may be underperforming between scheduled services appointments.

Some devices have been developed to clean the foamed bitumen dispensing device without undue dismantling of the rotary mixer. One example device for cleaning the nozzle of foamed bitumen dispensing device can be found in U.S. Pat. No. 6,887,013 which discloses a device that includes a closing element for unblocking an outlet nozzle. While the device of the '013 patent may be useful for cleaning some built-up material, there may be more efficient and effective methods and devices for cleaning and protecting the device from the hardened bitumen build up.

The foamed bitumen dispensing device of the present disclosure may solve one or more of the problems set forth above and/or other problems in the art. The current scope of the disclosure, however, is defined by the attached claims and not by the ability to solve any specific problem.

SUMMARY OF THE DISCLOSURE

According to one aspect of the present disclosure, a foamed bitumen dispensing device may include a body having a chamber and a bore fluidly connected to the chamber. The chamber may include an inlet for receiving bitumen. The foamed bitumen dispensing device may include a valve fluidly connected to the bore. The valve may have a movable valve member including an opening for dispensing bitumen. The foamed bitumen dispensing device may include a plunger configured to extend through the opening in the valve member.

According to another aspect of the present disclosure, a method of operating a foamed asphalt dispensing device having a bore for dispensing foamed asphalt, a plunger, and a valve may include moving a valve member of the valve between a closed configuration blocking the bore and an open configuration unblocking the bore. The method may also include moving the plunger through the bore in the open configuration for cleaning. The method may include dispensing foamed asphalt through the bore in the open configuration.

According to yet another aspect of the present disclosure, a milling machine may include a frame and a mixing chamber depending from the frame. The mixing chamber may include an outer wall and an opening through the outer wall. The milling machine may include a rotor rotatably coupled within the mixing chamber. The milling machine may include at least one foamed bitumen dispensing device coupled to the outer wall of the mixing chamber for dispensing foamed bitumen through the opening. The foamed bitumen dispensing device may include a body having a bore and a conduit for conveying foamed bitumen. The foamed bitumen dispensing device may include a valve coupled on the body and configured to cover the opening, and a plunger configured to extend through the opening.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "having," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus.

In this disclosure, relative terms, such as, for example, "about," "substantially," "generally," and "approximately" are used to indicate a possible variation of ±10% in a stated value or characteristic. For the purpose of this disclosure, the term "ground surface" is broadly used to refer to all types of surfaces that form typical roadways (e.g., asphalt, cement, clay, sand, dirt, etc.) or upon which paving material may be deposited in the formation of roadways. Although the current disclosure is described with reference to a rotary mixer, this is only exemplary. In general, the current disclosure can be applied as to any ground surface engaging machine, such as, for example, a cold planer or another paving-type machine.

Figure 1:
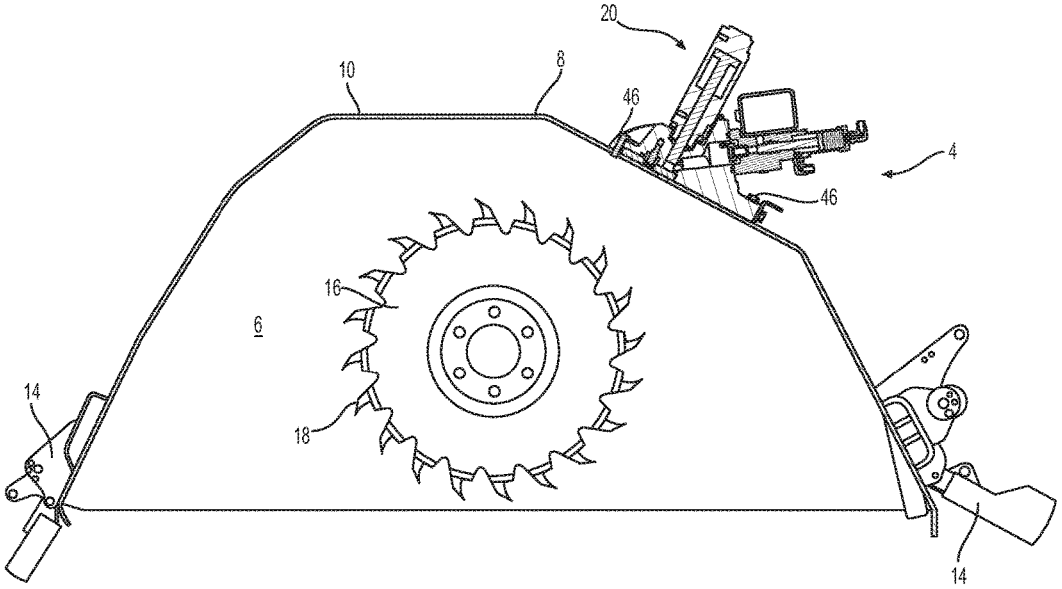
FIG. 1 illustrates a mixing chamber of a milling machine according to aspects of the present disclosure.

FIG. 1 illustrates a cutaway side view of an exemplary milling assembly 4 of a rotary mixer according to the present disclosure. The milling assembly 4 includes a mixing chamber 6, including an outer wall 8, and a rotor, e.g., drum 16, rotatably mounted within the outer wall 8. A plurality of cutting tools 18 are mounted on an outer surface of the drum 16 such that, during operation, rotation of the drum 16 drives one or more cutting tools 18 into the ground surface, thereby pulverizing the ground surface into debris. The mixing chamber 6 may further include one or more doors 14 attached to the outer wall 8. A foamed bitumen dispensing device 20 is coupled to an outer surface 10 of the outer wall 8. The foamed bitumen dispensing device 20 may be attached to the outer surface 10 of the outer wall 8 by one or more fasteners 46. The fasteners 46 may extend through outer wall 8 and into the mixing chamber 6. In some aspects of the present disclosure, a plurality of bitumen dispensing devices 20 may be positioned linearly along the outer wall 8 and may span a width of the mixing chamber 6.

Figure 2:
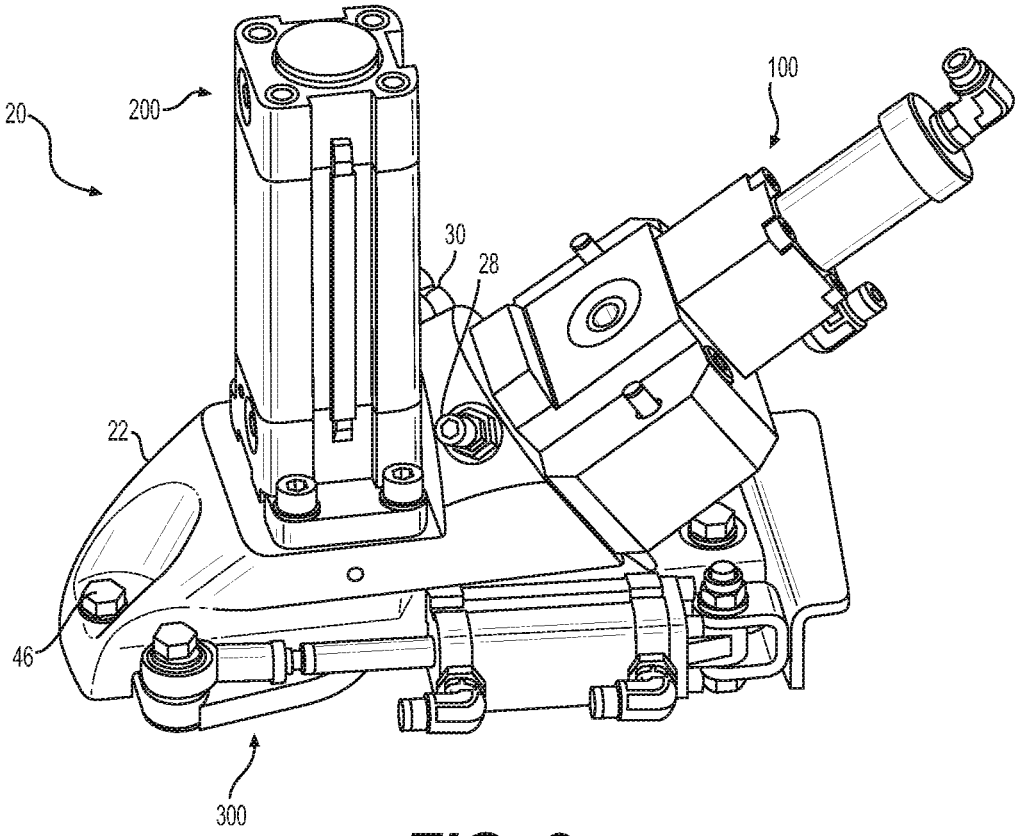
FIG. 2 illustrates a perspective view of an exemplary foamed bitumen dispensing device according to aspects of the present disclosure.

With reference to FIG. 2, an exemplary foamed bitumen dispensing device 20 may include a body 22, a supply system 100, a cleaning system 200, and a valve system 300. Bitumen may be received into the foamed bitumen dispensing device 20 from a bitumen supply conduit 120 (see FIG. 3). One or more connections for supplying additional materials, e.g., a water connector 28 and an air connector 30, may be coupled to the body 22.

Figure 3:
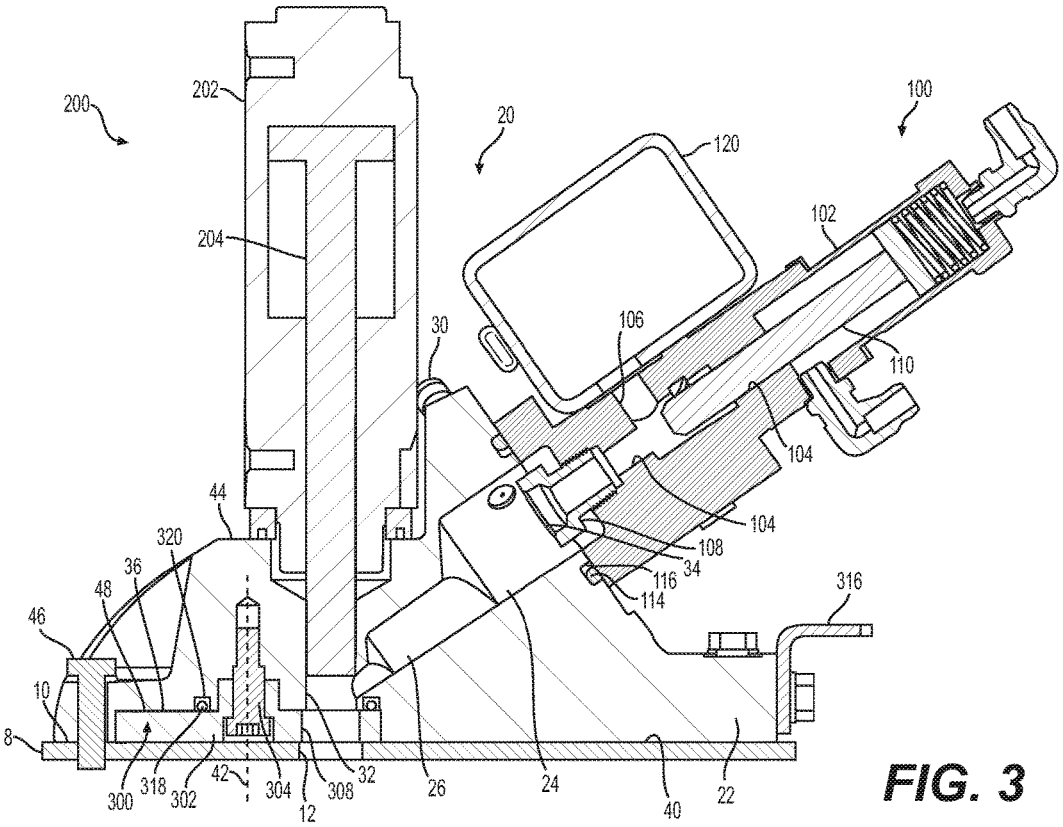
FIG. 3 illustrates a cross sectional view of the exemplary foamed bitumen dispensing device of FIG. 2.

FIG. 3 illustrates a cross-sectional view of the foamed bitumen dispensing device 20. The foamed bitumen dispensing device 20 is depicted in an open, dispensing configuration (also shown in FIG. 5D, below). The body 22 may be formed as a single unit with one or more cavities or conduits formed therein, e.g., by machining. The body 22 may include a foaming chamber 24 defined by a cavity in the body 22. The foaming chamber 24 may include a supply inlet 34 along a surface of the body 22 through which bitumen may be conveyed from the supply system 100. The body 22 may include one or more additional conduits, lines, or passages. For example, the body 22 may include appropriate passages to connect the water connector 28 and the air connector 30 (FIG. 2) to supply air and water to the foaming chamber 24. Water, air, bitumen, and other materials may be supplied to the foaming chamber 24 from one or more vessels on the rotary mixer or from another machine, e.g., a trailer having additional equipment, such as tanks, hoses, pumps, and metering units for supplying paving materials.

Air, water, and heated bitumen deposited within the foaming chamber 24 may combine to form foamed bitumen. A conduit 26 fluidly connects the foaming chamber 24 to a cleaning bore 32 to convey a flow of foamed bitumen. In some aspects of the present disclosure, the conduit 26 may comprise a conduit formed within the body 22. As shown in FIG. 3, the conduit 26 may include a plurality of interconnected bores of different sizes/diameters along a flow path from the foaming chamber 24 to the cleaning bore 32.

The cleaning bore 32 extends through a length of the body 22, e.g., from a top surface 44 to a bottom surface 40. The cleaning bore 32 may extend along an axis orthogonal to at least one of the outer surface 10 of the outer wall 8 or the bottom surface 40 of the body 22.

Figure 4:
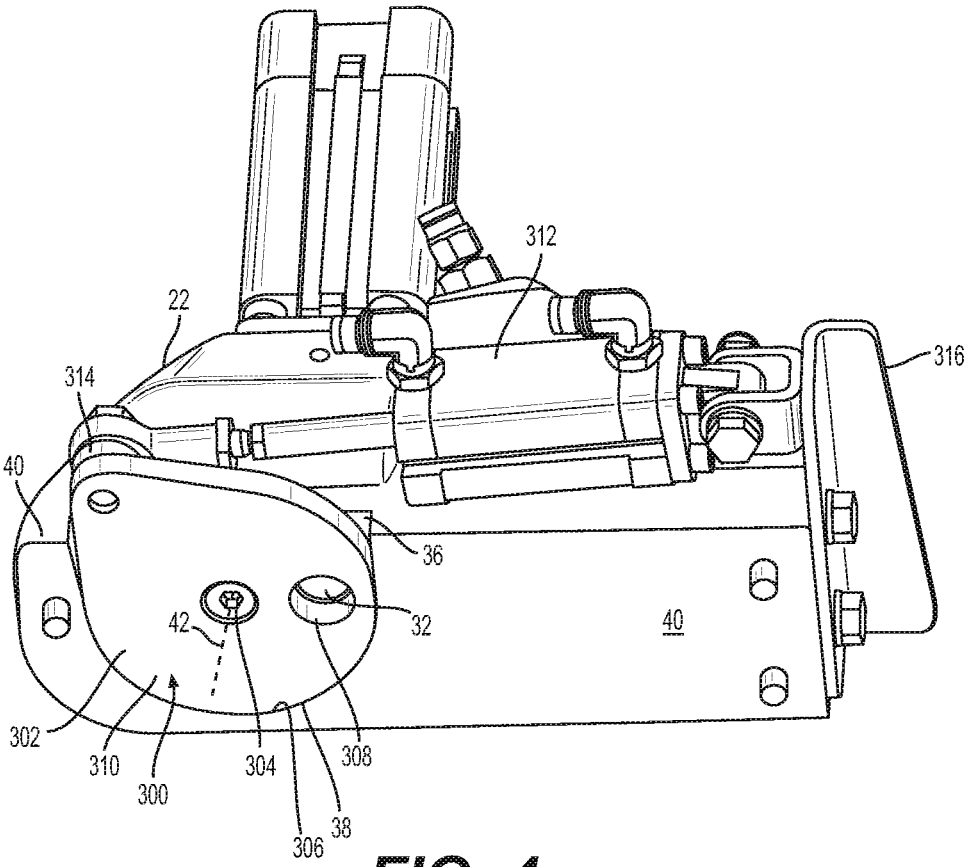
FIG. 4 illustrates a bottom view of the foamed bitumen dispensing device of FIG. 2.

As shown in FIGS. 3 and 4, the bottom surface 40 of body 22 may include an upwardly extending recess 36 shaped to received a valve member of 302 of the valve system 300. The recess 36 may include an top surface 48 intersecting the cleaning bore 32 so that the cleaning bore 32 exits through the top surface 48 of the recess 36. As shown in FIG. 4, the recess 36 may be open on one lengthwise side of the body 22, but closed on the other sides of the body 22.

Referring back to FIG. 2, the cleaning system 200 includes a cleaning housing 202 coupled to a surface, e.g., the top surface 44, of the body 22. The cleaning system 200 also includes a cleaning plunger 204 positioned to reciprocate within the cleaning housing 202. The cleaning plunger 204 may be actuated between a fully extended position and a fully retracted position. It is contemplated that the cleaning plunger 204 may be actuated pneumatically, hydraulically, or electrically. The cleaning plunger 204 may extend into at least part of the cleaning bore 32 in its fully retracted position. As will be explained in more detail below, in a fully extended position, the cleaning plunger 204 may extend through valve system 300, beyond the bottom surface 40 of the body 22, and into the mixing chamber 6.

The supply system 100 includes a supply housing 102 coupled, e.g. bolted, to the body 22. The supply housing 102 may include a supply bore 104 that provides fluid communication between the bitumen supply conduit 120 and the foaming chamber 24. A seal 114, e.g., an o-ring, may be located in a recess 116 of the body 22 at the interface between the body 22 and the supply housing 102 to prevent leakage. Heated bitumen may flow into the supply bore 104 through a bitumen inlet 106 of the supply housing 102. Heated bitumen may exit the supply bore 104 through a diffuser 108. The diffuser 108 may be positioned radially inward of the interface between the supply housing 102 and the body 22. In some aspects of the present disclosure, the diffuser 108 may extend partially into the foaming chamber 24 and be sized to assist in maintaining a desired flow of bitumen.

A supply plunger 110 is movable to reciprocate within the supply bore 104 of the supply housing 102 to cover and uncover the bitumen inlet 106. The supply plunger 110 may cover the bitumen inlet 106 in an extended position, thereby preventing flow between the bitumen supply conduit 120 and the foaming chamber 24. Conversely, when in a retracted position (shown in FIG. 3), the supply plunger 110 may uncover the bitumen inlet 106, thus allowing flow from the bitumen supply conduit 120 to the foaming chamber 24. It is contemplated that the supply plunger 110 may be controllably actuated pneumatically, hydraulically, or electrically, as is know in the art.

With reference again to FIGS. 3 and 4, the valve system 300 includes the valve member 302 rotatably coupled to the body 22. For example, the valve member 302 may be coupled to a bottom surface 40 of the body 22 so as to face an outer surface 10 of the mixing chamber outer wall 8. As noted above, the valve member 302 may be located within the recess 36 formed in the bottom surface 40 of the body 22. The valve member 302 may be rotatably coupled to the body 22 through a bushing 304, such that the valve member 302 rotates about an axis 42. At least part of the shape of the recess 36 and the valve member 302 may be complementary. That is, the recess 36 may approximately match a thickness and shape of the valve member 302. As illustrated in FIG. 4, a contour 306 of the valve member 302 may correspond to an outer periphery 38 of the recess 36. For example, the valve member 302 may be partially circular, having an arc and/or diameter corresponding an arc and/or diameter of the outer periphery 38 of the recess 36. The valve member 302 may be approximately teardrop shaped, disc shaped, or circular.

The valve member 302 may be connected to the body 22 such that the valve member 302 is coextensive with the bottom surface 40 of the body 22, e.g., a bottom surface 310 of the valve member 302 and the bottom surface 40 of the body 22 may be approximately coplanar.

The valve member 302 includes an opening 308 for selective communication with the cleaning bore 32. The opening 308 may be a circular hole/bore or any shape sufficient to unblock the cleaning bore 32 and permit foamed bitumen to flow from the body 22 through the valve member 302 and into the mixing chamber 6. The opening 308 may have a diameter approximately equal to the diameter of the cleaning bore 32 and/or slightly larger than the diameter of the cleaning plunger 204. The opening 308 may be located radially outward of the rotational axis 42 of the valve member 302. The valve member 302 may block or unblock deposition of foamed bitumen through the opening 308 depending on the position or orientation, e.g., rotation, of the valve member 302. Whereas, when the opening 308 is aligned with the cleaning bore 32 of body 22, the valve member 302 is located in the open position and the deposition of foamed bitumen is unblocked. When the opening 308 is rotated fully out of alignment with the cleaning bore 32, the valve member 302 is in a closed position and the deposition of foamed bitumen is blocked.

The valve system 300 further includes an actuator 312 connected to the valve member 302 to move the valve system 300 between the open position and the closed position. The actuator 312 may be, for example, a pneumatically, hydraulically, or electrically driven linear actuator. The actuator 312 is attached to the valve member 302 at a first end (rod end) and pivotally fixed to the body 22 at a second end, e.g., via an end plate 316. The actuator 312 may be attached to the valve member 302 at a periphery of the valve member 302 via a rotatable connection 314. For example, the connection 314 may be located towards the apex of a teardrop shaped valve member 302. The connection 314 may include a bearing, bushing, hinge, or other assembly that facilitates the translation of the linear motion of the actuator 312 into rotational motion of the valve member 302. Thus, extension or retraction of the actuator 312 rotates the valve member 302 about the rotational axis 42 of the valve member 302. The actuator 312 may be orientated parallel to the bottom surface 40 of the body 22 and/or an outer surface 10 of the outer wall 8 of the mixing chamber 6. During operation, the actuator 312 may move, e.g., linearly, from a fully extended position, corresponding to the open position of the valve system 300, to a fully retracted position, corresponding to the closed position of the valve system 300.

When the valve system 300 is in the open position, the opening 308 aligns with the cleaning bore 32 and permits foamed bitumen to flow through the opening 308 into the mixing chamber 6. When in the closed position, the opening 308 is offset from the cleaning bore 32, thereby completely blocking the cleaning bore 32 and blocking foamed bitumen from depositing within the mixing chamber 6.

In some configurations, the actuator 312 may operate more than one valve system 300 for more than one foamed bitumen dispensing device 20. For example, the actuator 312 may be coupled to more than one valve member 302 such that extension or retraction of the actuator 312 moves multiple valve members 302 simultaneously.

According to some aspects of the present disclosure, a seal 318, e.g., an o-ring, (FIG. 3) may be positioned between the valve member 302 and the body 22. For example, seal 318 may be located in a circular recess or groove 320 in the body 22 and encircle the cleaning bore 32 and the opening 308 along a top surface of the valve member 302. The seal 318 may circumscribe the cleaning bore 32 and the opening 308 regardless of whether the valve system 300 is in an open or closed position.

In some aspects of the present disclosure, the body 22 may also include a cavity or bores (not shown) configured to receive a heating element. The cavity may be located between the foaming chamber 24 and the bottom surface 40 of the body 22. An exemplary heating element may comprise a resistive electric element. The heating element may at least partially prevent solidification of bitumen within the body 22 and on the outer wall 8 by conducting heat through the body 22.

INDUSTRIAL APPLICABILITY

The present disclosure finds potential application with any ground surface engaging or ground surface treatment machine which involves deposition of foamed bitumen or other asphalt emulsions and/or paving materials (e.g., mineral additives or chemical agents used to stabilize pulverized ground surface). The disclosed foamed bitumen dispensing device 20 may help to remove built-up material that could inhibit the flow of foamed bitumen into the mixing chamber 6. Thus, the disclosed foamed bitumen dispensing device 20 may assist in maintaining or improving flow of foamed bitumen into the mixing chamber 6, and reduce the amount time, effort, and expense involved in servicing procedures. Operation of the foamed bitumen dispensing device 20 in connection with FIGS. 5A-5D will now be described.

Figure 5A:
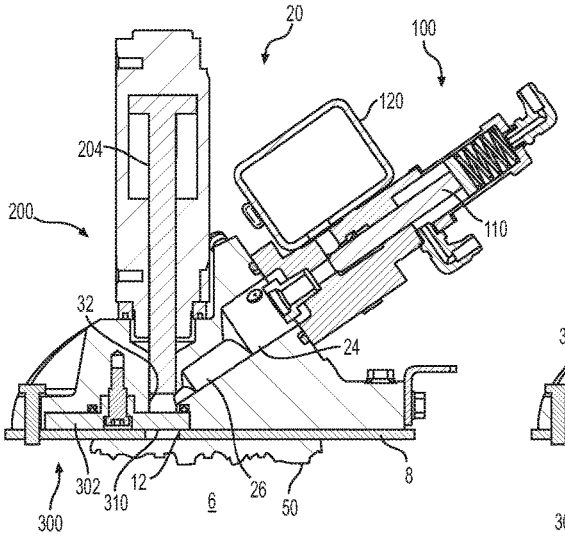
FIGS. 5A-5D show various operating modes of the foamed bitumen dispensing device of FIG. 2.

FIG. 5A shows a foamed bitumen dispensing device 20 in a closed configuration wherein the supply system 100 is in a closed position, the cleaning plunger 204 is fully retracted, and the valve assembly 300 is in a closed position. That is, the opening 308 of the valve member 302 is offset from the cleaning bore 32 such that the valve member 302 covers an outlet of the cleaning bore 32. As seen in FIG. 5A, build-up 50, such as, e.g., hardened bitumen, binding agents, pulverized ground surface, and other particulates, may partially cover the bottom surface 310 of the valve member 302, the mixing chamber outer wall inlet 12, and an inner surface of the mixing chamber outer wall 8. The foamed bitumen dispensing device 20, may then move to an "open" configuration as shown in FIG. 5B.

Figure 5B:
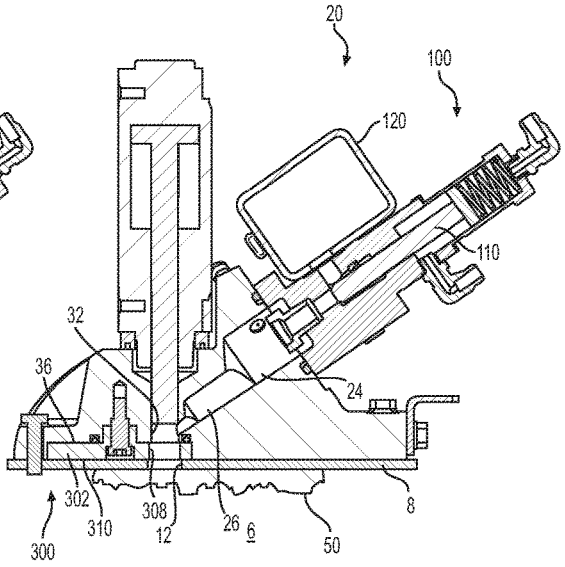

FIG. 5B illustrates the valve member 302 moved to an open configuration. To move to an open configuration, actuator 312 (FIG. 4) rotates the valve member 302 to align the opening 308 with the cleaning bore 32. Rotating the valve member 302 within recess 36 may create a shear force against build-up 50 on the bottom surface 310 of the valve member 302, e.g., by forcing the build-up 50 against the sides of the mixing chamber outer wall inlet 12. This shearing action may help to loosen or remove some build-up 50 adjacent the outer wall inlet 12. After moving the valve member 302 to the open configuration, the foamed bitumen dispensing device 20 may operate through a cleaning procedure to remove some of the build-up 50.

Figure 5C:
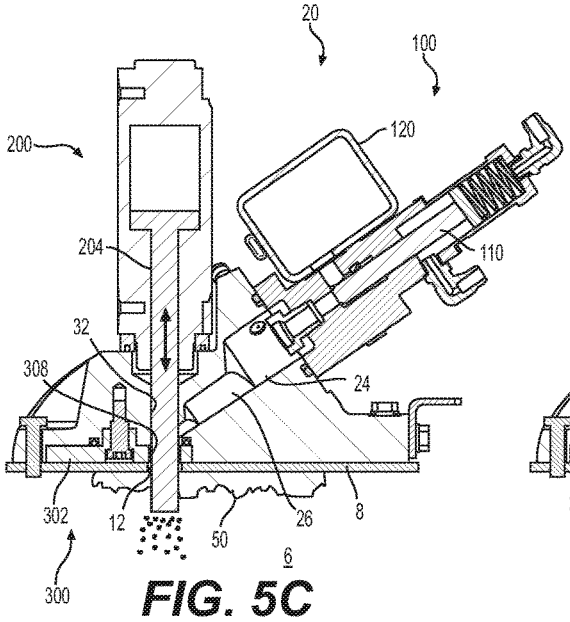

FIG. 5C illustrates the foamed bitumen dispensing device 20 performing a cleaning procedure. During cleaning, the cleaning plunger 204 is actuated towards an extended position, extending through the opening 308 and at least partially into the mixing chamber 6. During this extension of the cleaning plunger 204, the cleaning plunger 204 pushes build-up 50 out of the foamed bitumen dispensing device 20 and clears the opening 308 and the mixing chamber outer wall inlet 12. The cleaning plunger 204, then moves to a retracted position, unblocking the foaming chamber 24 from the cleaning bore 32.

Figure 5D:
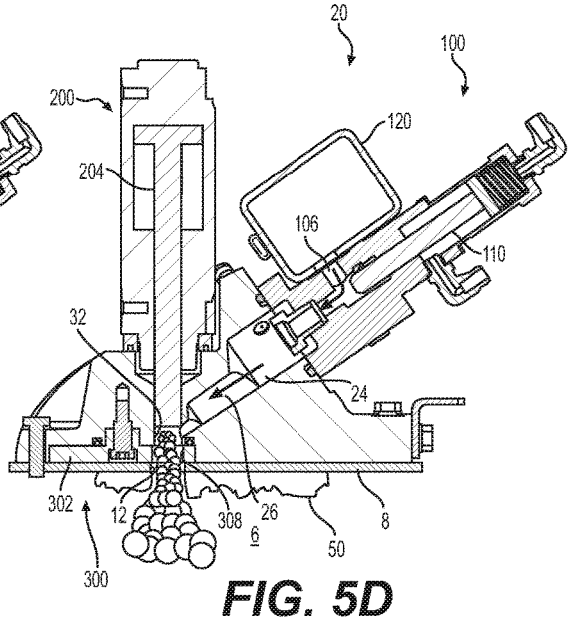

FIG. 5D illustrates the foamed bitumen dispensing device 20 dispensing foamed bitumen. The cleaning plunger 204 is retracted, the valve assembly 300 in an open position, and the supply system 100 is in an open position such that the supply plunger 110 is moved to a retracted position to uncover the bitumen inlet 106 to allow bitumen to flow from the bitumen supply conduit 120 into the foaming chamber 24. Water and air connectors 28, 30 (FIG. 2) are controlled to supply air and water to the foaming chamber 24 to mix with the heated bitumen. The foamed bitumen then flows from the foaming chamber 24 through the conduit 26, the cleaning bore 32, the opening 308, and the outer wall inlet 12 to enter the mixing chamber 6. As mentioned above, the foamed bitumen may mix with particulates of the ground surface within the mixing chamber 6 to form a stabilized surface for construction.

It will be apparent to those skilled in the art that various modifications and variations can be made to the disclosed device without departing from the scope of the disclosure. Other embodiments of the disclosure will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A foamed bitumen dispensing device, comprising:

a body having a chamber and a bore fluidly connected to the chamber, wherein the chamber includes an inlet for receiving bitumen, and wherein the bore includes an outlet for dispensing bitumen;

a valve fluidly connected to the bore, the valve having a movable valve member including an opening for dispensing bitumen, wherein the valve is positioned adjacent to the outlet of the bore to close the outlet of the bore; and a plunger configured to extend through the bore and through the opening in the valve member when the valve member is open.

2. The device of claim 1, wherein the valve member is disc shaped.

3. The device of claim 2, wherein the opening is a hole in the disc shaped valve member.

4. The device of claim 2, wherein the valve member is oriented normal to the bore.

5. The device of claim 1, wherein the valve member is movably connected to a bottom surface of the body.

6. The device of claim 5, wherein the valve member is located in a recess formed in a bottom surface of the body.

7. The device of claim 1, wherein the valve member is rotatably connected to the body, and wherein the plunger is configured to extend beyond the valve member.

8. The device of claim 1, wherein the opening is located radially outside a rotational axis of the valve member.

9. The device of claim 1, further including a linear actuator coupled to the valve member.

10. The device of claim 9, wherein the actuator extends in a direction normal to the bore.

11. A method of operating a foamed asphalt dispensing device having a bore for dispensing foamed asphalt, a plunger, and a valve, the method comprising:

moving a valve member of the valve from a closed configuration in which the valve blocks an outlet of the bore to an open configuration in which the valve does not block the outlet of the bore;

cleaning the bore and an area exterior to the bore by moving the plunger from a retracted position where the plunger is not positioned within the bore to an extended position where a portion of the plunger extends through and beyond the outlet of the bore;

moving the plunger from the extended position to the retracted position; and dispensing foamed asphalt through the bore with the valve in the open configuration.

12. The method of claim 11, wherein moving the valve member from the closed configuration to the open configuration includes rotating the valve member.

13. The method of claim 11, wherein moving the plunger includes moving the plunger through and beyond a hole in the valve member.

14. The method of claim 11, wherein the cleaning includes unblocking the outlet of the bore.

15. The method of claim 11, wherein moving the valve member includes moving a linear actuator coupled to the valve member.

16. A milling machine, comprising:

a frame;

a mixing chamber depending from the frame, the mixing chamber including an outer wall and an opening through the outer wall;

a rotor rotatably coupled within the mixing chamber; and at least one foamed bitumen dispensing device coupled to the outer wall of the mixing chamber for dispensing foamed bitumen through the opening;

wherein the at least one foamed bitumen dispensing device comprises:

a body having a bore and a conduit for conveying foamed bitumen;

a valve coupled to the body and configured to cover the opening and separate the bore and the mixing chamber; and a plunger configured to extend through a portion of the valve and through the opening.

17. The machine of claim 16, wherein the body of the at least one foamed bitumen dispensing device includes a recess, and wherein at least a portion of the valve is disposed in the recess.

18. The machine of claim 17, wherein at least a portion of the recess includes a shape that is complimentary to the valve.

19. The machine of claim 16, wherein the body of the at least one foamed bitumen dispensing device includes a foaming chamber.

20. The machine of claim 16, wherein the valve is positioned to selectively close an outlet of the foamed bitumen dispensing device, and wherein the plunger is movable between a retracted position where the plunger is not positioned within the bore to an extended position where a portion of the plunger extends through the bore and into the mixing chamber.

* * * * *